US005183093A

United States Patent [19]

Kraeutler

[11] Patent Number: 5,183,093

[45] Date of Patent: Feb. 2, 1993

[54] REMOVABLE SEALING DEVICE FOR A RAISABLE-CURTAIN INDUSTRIAL DOOR

[75] Inventor: Bernard Kraeutler, Dunieres, France

[73] Assignee: Nergeco (société anonyme), Dunieres, France

[21] Appl. No.: 845,613

[22] Filed: Mar. 4, 1992

[30] Foreign Application Priority Data

Mar. 5, 1991 [FR] France ..... 91 02587

[51] Int. Cl.[5] ..... E06B 9/06

[52] U.S. Cl. ..... 160/84.1; 160/23.1; 160/133

[58] Field of Search ..... 160/84.1, 133, 201, 160/264, 267.1, 268.1, 273.1, 188, 274, 209, 193, 271, 23.1, 26

[56] References Cited

U.S. PATENT DOCUMENTS

| | | | |
|---|---|---|---|
| 4,197,896 | 4/1980 | Reichstadt | 160/26 X |
| 4,327,796 | 5/1982 | Rochman | 160/26 X |
| 4,359,079 | 11/1982 | Bledsoe . | |
| 4,610,292 | 9/1986 | Hausmann et al. | 160/23.1 X |
| 4,649,980 | 3/1987 | Kunz | 160/26 X |
| 4,725,000 | 2/1988 | Deziel | 160/84.1 X |
| 4,828,003 | 5/1989 | Kraeutler | 160/84.1 |
| 5,072,767 | 12/1991 | Kraeutler | 160/84.1 |
| 5,092,388 | 3/1992 | Evers | 160/26 X |

FOREIGN PATENT DOCUMENTS

| | | |
|---|---|---|
| 137133 | 4/1985 | European Pat. Off. . |
| 1683454 | 5/1970 | Fed. Rep. of Germany . |
| 923177 | 4/1963 | United Kingdom . |

*Primary Examiner*—Blair M. Johnson
*Attorney, Agent, or Firm*—Sughrue, Mion, Zinn, Macpeak and Seas

[57] ABSTRACT

A sealing device for a raisable-curtain warehouse door, the door comprising a curtain and a rigid frame having two vertical lateral uprights, 1,2 interconnected at their top ends by a downwardly-open channel-section cross-member 3 having a web 4, and two flanges, 5,6 and housing mechanical members for operating the curtain, the curtain being capable of being lowered or raised between the uprights. The highest portion of the curtain is situated at a certain distance below the web of the cross-member, below any mechanical members that may be below the cross-member, and a cover, 15;35 having two parallel longitudinal edges, namely a top edge and a bottom edge, is fastened via its top edge to the bottom edge of one of the flanges of the cross-member, and is maintained in an orientation such that its bottom edge is placed against the top portion of the curtain so as to provide continuous closure between the cross-member and the curtain.

9 Claims, 3 Drawing Sheets

REMOVABLE SEALING DEVICE FOR A RAISABLE-CURTAIN INDUSTRIAL DOOR

The present invention relates to raisable-curtain industrial doors of the type comprising a rigid frame constituted by two vertical lateral uprights interconnected at their top ends by a cross-member.

BACKGROUND OF THE INVENTION

This type of door is intended to be placed around a bay formed through a wall for the purpose of opening or closing the bay. Closing is performed by a curtain which is capable of moving down between the uprights or of being raised to be collected at the top beneath the cross-member, or within the cross-member, or to one side thereof. The curtains may be in the form of a flexible sheet or in the form of rigid panels that are hinged to one another, with the curtain being reinforced by horizontal bars which may also serve as hinges and whose ends slide for guidance purposes in slideways that are formed by the uprights, or that are disposed in the uprights. While a curtain is being raised, it may be wound up inside the cross-member or it may be folded up concertina-like beneath the cross-member, or it may be offset laterally between guide rails. The cross-member is generally a channel section member whose opening faces downwards. The mechanical units for actuating and controlling operation of the door are placed inside the cross-member, e.g. a shaft onto which the curtain or lifting straps are wound, an electric motor, an end-of-stroke contact, etc.

It is important for these doors to be sealed at the top, particularly when the curtain is down in its closed position. That is why the top end of the curtain is placed as high as possible inside the cross-member, and when the top end of the curtain is stationary it is fixed to the web of the top cross-member.

However, another requirement is to have access to the mechanism for maintenance and repair. If the top portion of the curtain is placed as high as possible inside the cross-member, then it masks the mechanism so that it can be accessed from one side only, thereby limiting the conditions in which such doors can be installed.

An object of the invention is to provide a removable sealing device for a raisable-curtain industrial door enabling easy access to the mechanism of the door under all conditions and ensuring that the fixed portion of the door is sealed under all conditions, in particular when the door is closed.

SUMMARY OF THE INVENTION

The present invention provides a sealing device for a raisable-curtain industrial door, the door comprising a curtain and a rigid frame, said frame comprising two vertical lateral uprights interconnected at their top ends by a down-wardly-open channel-section cross-member having a web, and two flanges extending downwards to respective bottom edges. and housing mechanical members for operating the curtain, and said curtain having a top portion and being capable of being lowered or raised between the uprights, wherein the top portion of the curtain is situated at a certain distance below the web of the cross-member, below any mechanical members that may be below the cross-member, and a cover having two parallel longitudinal edges, namely a top edge and a bottom edge, is fastened via its top edge to the bottom edge of one of the flanges of the cross-member, and is maintained in an orientation such that its bottom edge is placed against the top portion of the curtain so as to provide continuous closure between the cross-member and the curtain.

In one embodiment, the top portion of the curtain is stationary, and said top portion is fixed to a bar extending between the uprights, at a distance from the web of the cross-member enabling the mechanical members for actuating the curtain to be placed between said bar and the web of the cross-member, the bottom edge of the cover being applied against the stationary top portion of the curtain. Under such circumstances, the fixing bar may be lined with shock-absorbing components.

In another embodiment, the top portion of the curtain is moving, the curtain running through the top portion of the door via a substantially stationary position, said position being placed beneath the mechanical members for actuating the curtain, and the bottom edge of the cover being maintained in the proximity of said substantially stationary position. Under such circumstances, the bottom edge of the cover may be provided with rotatably-mounted rollers or wheels.

Advantageously, at least one flange of the cross-member has an edge folded through 180°, and the top edge of the cover is also folded through 180°, the two edges being engaged one in the other so that the bottom edge of the flange of the cross-member supports the cover. A gasket may be interposed between the folded flange of the cross-member and the folded top edge of the cover.

The bottom edge of the cover may be provided with a sealing gasket, such as a rim of rubber, a row of thrush bristles, or the like.

The bottom edge of the cover may be lined with shock absorber components.

BRIEF DESCRIPTION OF THE DRAWINGS

Embodiments of the invention are described by way of example with reference to the accompanying drawings, in which.

DETAILED DESCRIPTION

Figure 1:
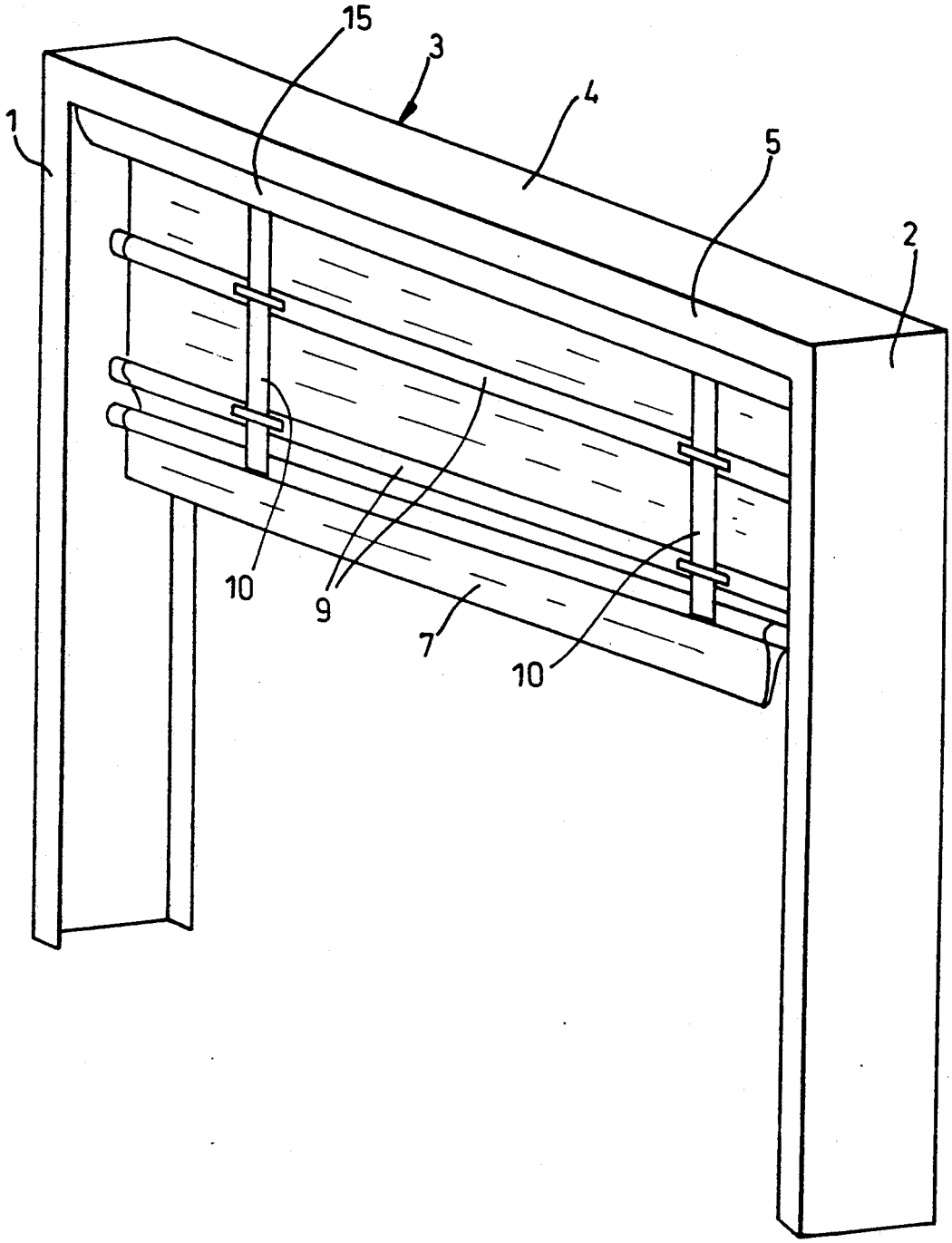
FIG. 1 is a perspective view of an embodiment of the invention having a raisable-curtain door in which the curtain is constituted by a flexible material that is reinforced by horizontal reinforcing bars, the curtain folding up concertinalike at the top of the door.
Figure 2:
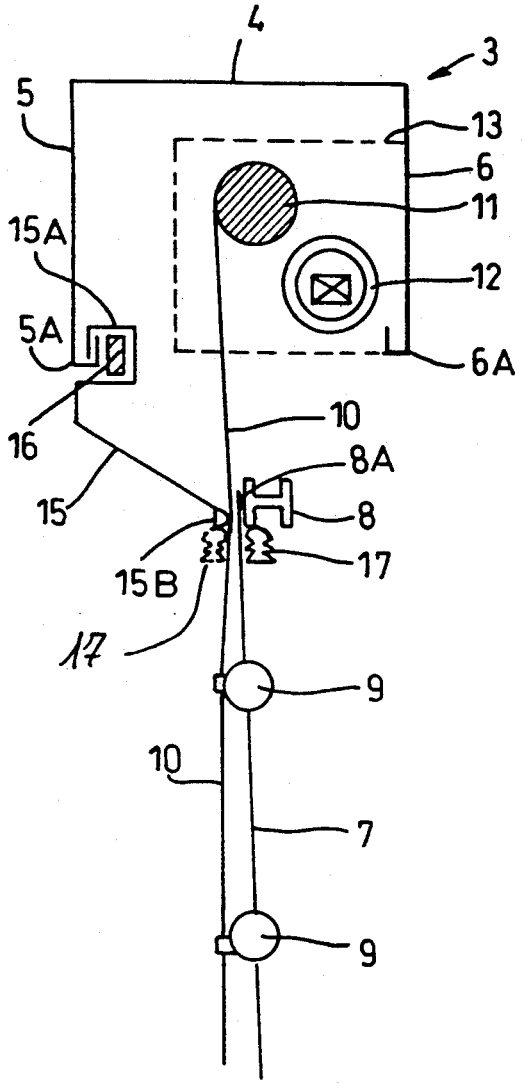
FIG. 2 is a section view of the same door on a vertical plane between the uprights and perpendicular to the plane of the door.

In the embodiment shown in FIGS. 1 and 2, the door includes a rigid frame constituted by two vertical lateral uprights 1 and 2 interconnected at their top ends by a cross-member 3 in the form of a downwardly-open channel section beam comprising a web 4 and two flanges 5 and 6 (only one of which is visible in FIG. 1). The top edge of a curtain 7 is suspended from a bar 8 disposed beneath the cross-member 3. The curtain 7 is of the type that can be folded up concertinalike at the top of the door. To make this possible, it is constituted by a flexible sheet material which is reinforced by equidistant horizontal bars 9 whose ends are guided in slideways constituted by, or formed in, the uprights 1 and 2. The curtain may be raised by lifting straps 10 whose bottom ends are fixed to the bottom bar, and which pass through loops fixed on at least some of the other bars. One example of such a curtain is disclosed in patent application EP-0 413 857 and in U.S. Pat. No. 5,072,767. To raise the curtain, the straps may be wound onto a wind-up shaft 11 placed inside the cross-member. The cross-member may also house other mechanical members such as a motor 12, a transmission 13, and end-of-stroke contact, electrical apparatuses, etc. These components may also be placed entirely or partially inside the uprights 1 and 2. Examples of such actuator members are described in patents EP-0 254 639 and U.S. Pat. No. 4,828,003.

According to the invention, a cover 15 is placed between the bottom edge 5A of the flange 5 of the cross-member and the line 8A of attachment between the curtain and the bar 8. In order to obtain fixing that is reliable but simple for rapid installation and removal, the top edge 15A of the cover has a 180° double fold (i.e. it is folded twice through 90°) and the bottom edge 5A of the flange 5 is folded similarly. (Additional folding may be provided for reasons of appearance.) Advantageously, a gasket 16 may be placed between two folds, one on the top member and the other on the cover, thereby providing sealing and eliminating vibration and noise. The cover is appropriately held at its ends, either to the bar 8, or else to the uprights 1 and 2. The bottom edge 15B of the cover may be lined with a suitable gasket for providing sealing against the curtain while allowing the straps to go past.

It is possible to provide a similar cover on the other face of the door. In general, that is not necessary since it will be against a wall. The bottom edge 6A of the flange may, where appropriate, have a corresponding fold, in particular for the purposes of rationalizing manufacture or installation.

This disposition has numerous advantages. The first is not technical but relates to appearance. The mechanism is hidden from view and the door is cleaner in appearance. The cover may carry messages: trademarks, conditions of employment, etc.

It can be seen that after the cover has been removed, all of the inside of the cross-member is accessible, from either of its two sides. If there were no cover, it would be necessary to attach the top edge of the curtain to the web of the cross-member since otherwise there would be a large passage for air flow through the top of the cross-member. Under such circumstances, the curtain would hinder easy access to the mechanical or electrical components placed on either side thereof.

The cover also provides protection against falling objects. It is recalled that such doors may operate between 500 and 1000 times a day, and sometimes even more. Shock and vibration give rise to breakage of the straps, of their fastenings, of the wind-up shaft, etc. These pieces can be dangerous if they fall, and the cover provides protection, particularly on the side where it is most required since that is the side where personnel are most likely to need to stand next to the door.

If the top cross-member is formed with folds on both sides, a cover may be placed on one side or the other, thereby enabling the door to be turned about or to have its other side placed against the wall without being turned about, e.g. to take account of local conditions of wind or differing air pressures.

Finally, because the curtain is raised quickly and because its upward motion is stopped suddenly, it is possible in accordance with the invention to place one or more shock absorbing components 17 to absorb, in particular, the shock of the top bar striking against the edge of the cover which is then used as a support for the shock absorbing component, or else striking against the bar 8 on which the curtain is secured.

The above description for a flexible curtain is equally applicable to a curtain made up of panels that are hinged to one another and that fold up concertina-like beneath the door when disengaging the bay.

The following figures are section views analogous to FIG. 2, but for other embodiments.

Figure 3:
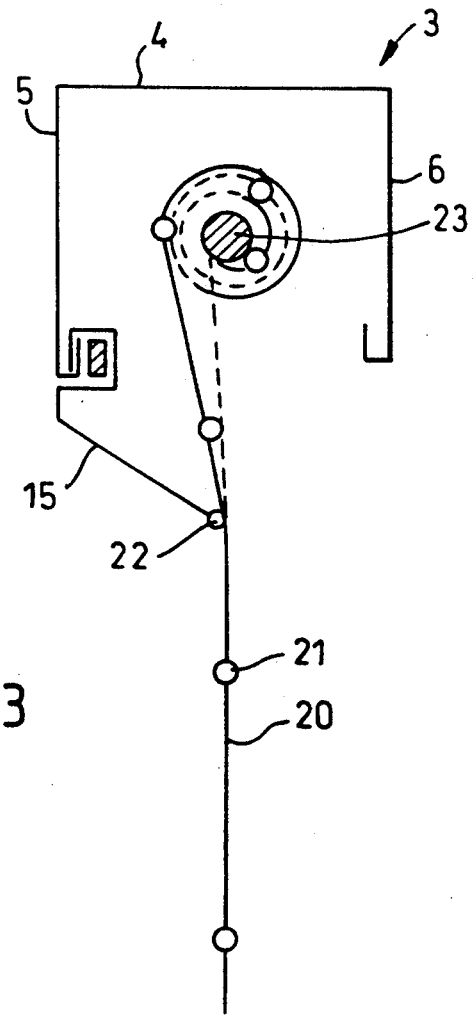
FIG. 3 is a view analogous to FIG. 2 for a variant embodiment in which the curtain is raised by being wound up at the top of the door.

In FIG. 3, the top cross-member 3 is identical to that of FIGS. 1 and 2, having a web 4, and two flanges 5 and 6. The cover 5 is mounted in the same way. In this embodiment, the curtain 20 as reinforced by reinforcing bars 21 is collected at the top by being wound onto a shaft 23. Here again, the cover provides visual masking, sealing, and protection against falling objects, and on being removed it gives very easy access to the mechanism. It also allows the door to be used the other way round. With this kind of curtain, a shock absorbing effect is not required. In order to position the curtain in a vertical plane, the bottom edge of the cover allows the curtain to pass to a stationary position where it coincides with guide slideways. In order to reduce friction, the bottom edge of the cover 15 may be provided with suitably distributed rollers or wheels 22.

The curtain may wind up in the opposite direction. The important point is that it hangs vertically from the rim at the bottom edge of the cover, once it has been lowered into its rest position. It does not matter if there is a gap when the curtain is not fully down.

Figure 4:
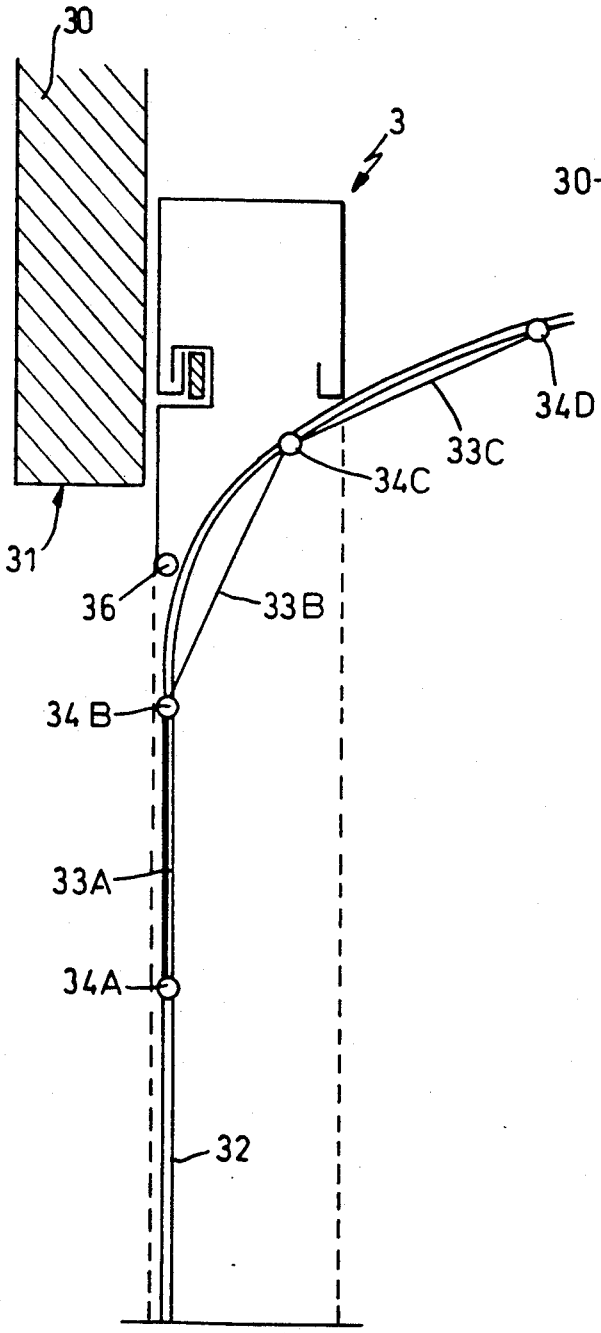
FIGS. 4 and 5 are views analogous to FIGS. 2 and 3 for yet another embodiment applicable to a sectional door, i.e. a door constituted by hinged panels that are guided in lateral rails so that on being raised they are offset away from the plane of the door.
Figure 5:
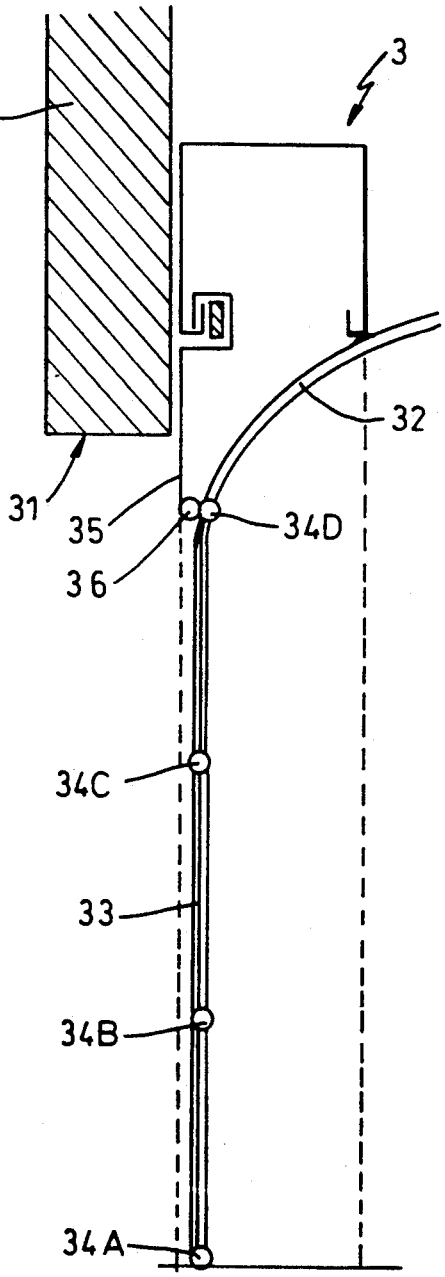

FIGS. 4 and 5 are analogous views for a sectional door, with the curtain being shown partially raised in FIG. 4 and fully lowered in FIG. 5.

The top cross-member 3 of the door is applied against a wall 30 above a bay 31. Slideways 32 are placed on both sides, with the portions thereof that correspond to the bay being vertical, while higher up the slideways are curved so as to deflect the curtain away from the plane of the bay. the curtain 33 is constituted in this case by three panels 33A, 33B, and 33C which are hinged to one another and to bars 34A–D whose ends slide in the slideways 32. In the lower disposition, the curtain closes the bay, and all the panels lie in the same plane (FIG. 5). In this example, the shape of the cover 35 is slightly different. Its bottom edge is provided with a sealing rim 36. As can be seen in FIG. 4, while the curtain is moving upwards, sealing is provided only when a reinforcing and guiding bar is going past the rim, otherwise there is a gap when it is a middle region of a panel that is level with the rim. However, this state is transient and applies only when the door is open, at least in part. When the door is closed, the curtain is sealed. The cover provides its sealing and protective function. Moving the cover gives access to the inside of the cross-member from the face of the door that is opposite from the sloping extensions of the slideways.

In this case, the curtain does not pass via a stationary horizontal line, but via a line that is nearly stationary to provide sealing, at least when in the closed position.

It may be observed that the present invention is also applicable to doors having a curtain that moves sideways.

I claim:

1. A sealing device for a raisable-curtain industrial door, the door comprising a curtain and a rigid frame, the curtain being raised and gathered at a top of the door when in an open condition, and hanging down from the top of the door, when in a closed condition, said frame comprising two vertical lateral uprights (1,2) interconnected at their top ends by a downwardly-open channel-section cross-member (3) having a web (4) and two flanges (5,6) extending downwards to respective bottom edges, and said cross-member housing mechanical members for operating the curtain, and said curtain having a top portion and being capable of being lowered or raised between the uprights, wherein the top portion of the curtain is situated at a certain distance below the web of the cross-member, and a horizontal cover member (15;35) having parallel longitudinal top and bottom edges removably fastened at said top edge to a bottom edge of one of the flanges of the cross-member, and oriented such that the bottom edge (15B;22;36) of the cover member bears against the top portion of the curtain when in the closed condition to provide a continuous horizontal closure between the cross-member and the curtain when said curtain is in the closed condition to prevent air flow through the cross-member, and to enable ready access to the mechanical members upon removal of the cover member.

2. A device according to claim 1, in which the top portion of the curtain is stationary, and said top portion is fixed to a bar (8) extending between the uprights, at a distance from the web of the cross-member enabling the mechanical members for operating the curtain to be placed between said bar and the web of the cross-member, the bottom edge of the cover being applied against the stationary top portion of the curtain.

3. A device according to claim 1, in which the top portion of the curtain traverses, during raising and lowering, a substantially stationary position proximate a top portion of the door, said position being disposed beneath the mechanical members for operating the curtain, and the bottom edge of the cover being disposed in the proximity of said substantially stationary position.

4. A device according to claim 1, in which at least the bottom edge of said one of the flanges is folded through 180°, and the top edge of the cover is also folded through 180°, the two folded edges being engaged one in the other so that the bottom edge of the flange of the cross-member supports the cover.

5. A device according to claim 4, in which a gasket is interposed between the folded flange of the cross-member and the folded top edge of the cover.

6. A device according to claim 1, in which the bottom edge of the cover is provided with sealing means, such as a rim of rubber or a row of brush bristles.

7. A device according to claim 2, in which discrete shock absorber components (17) are fixed to the bottom edge of the cover.

8. A device according to claim 2, in which discrete shock absorber components (17) are fixed to the bar to which the top portion of the curtain is fixed.

9. A device according to claim 3, in which the bottom edge of the cover is provided with rotatably-mounted rollers or wheels.

* * * * *